US007095968B2

(12) United States Patent
Akita et al.

(10) Patent No.: US 7,095,968 B2
(45) Date of Patent: Aug. 22, 2006

(54) IMAGE FORMING METHOD AND APPARATUS FOR SETTING AN IMAGE FORMING PARAMETER BASED ON A PRINTING MEDIUM

(75) Inventors: Masanori Akita, Shizuoka (JP); Tomoaki Nakai, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 88 days.

(21) Appl. No.: 10/862,384

(22) Filed: Jun. 8, 2004

(65) Prior Publication Data

US 2005/0013621 A1 Jan. 20, 2005

(30) Foreign Application Priority Data

Jun. 24, 2003 (JP) ..... 2003-180267

(51) Int. Cl.
*G03G 15/00* (2006.01)

(52) U.S. Cl. ..... 399/45

(58) Field of Classification Search ..... 399/45
See application file for complete search history.

(56) References Cited

U.S. PATENT DOCUMENTS 5,471,281 A 11/1995 Hayashi et al.
5,481,334 A 1/1996 Arimoto et al.
5,604,596 A * 2/1997 Ukai et al. ..... 399/366
5,617,187 A 4/1997 Hayashi et al.
5,631,723 A 5/1997 Arimoto et al.
5,650,863 A 7/1997 Utagawa et al.
5,689,757 A * 11/1997 Ferrante et al. ..... 399/45
5,925,889 A 7/1999 Guillory et al.
6,051,826 A 4/2000 Arimoto et al.
6,078,682 A 6/2000 Tanioka et al.
6,668,144 B1 12/2003 Maruyama
6,785,507 B1 * 8/2004 Asai et al. ..... 399/45
2002/0071688 A1 6/2002 Maruyama

FOREIGN PATENT DOCUMENTS

JP 11-216938 8/1999
JP 11-271037 10/1999
JP 2002-182518 6/2002

* cited by examiner

*Primary Examiner*—David M. Gray
*Assistant Examiner*—Ruth N. LaBombard
(74) *Attorney, Agent, or Firm*—Fitzpatrick, Cella, Harper & Scinto

(57) ABSTRACT

The type of printing medium on which an image will be formed is discriminated based upon the image of the medium surface read by an image reading unit for reading the surface as an image. If the discriminated medium type is other than a prescribed printing medium, the image is formed without changing an image formation parameter. When the type of printing medium and the state of the surface are discriminated, image formation can be performed in the most stable image forming mode if an abnormality occurs.

20 Claims, 10 Drawing Sheets

IMAGE FORMING METHOD AND APPARATUS FOR SETTING AN IMAGE FORMING PARAMETER BASED ON A PRINTING MEDIUM

FIELD OF THE INVENTION

This invention relates to a technique, which has image reading means for reading the surface of a printing medium on which an image will be formed, for setting an image forming parameter, which is based upon the surface image that has been read, and forming an image.

BACKGROUND OF THE INVENTION

In an image forming apparatus such as a laser printer, a plurality of printing modes are set in order to obtain the optimum image for dealing with a printing paper of a large number of types. It is so arranged that each printing mode is set by the user him/herself at the time of printing. This means that the user is required to have the knowledge for distinguishing the type of paper and that the user must set the apparatus to the type of paper him/herself. Another problem is that the best image will not be obtained if the setting is made erroneously.

An image forming apparatus that has become available in recent years detects the difference between the amount of regular reflected light, which is reflected by a paper surface, and the amount of diffused reflected light and discriminates the type of paper automatically, thereby obtaining the optimum image by performing control of image formation that conforms to the result of detection (e.g., see Patent Reference 1: Japanese Patent Application Laid-Open No. 11-216938).

FIG. 9 is a sectional view illustrating a printer glossmeter described in Patent Reference 1. As shown in FIG. 9, a gloss detector 200 has a block 210 mounted on a printed circuit board 220 in the usual manner. A light-source tube 212 on an axis 213 and a reflecting tube 214 on an axis 215 are formed inside the block 210. A light source 216 is situated inside the light-source tube 212 and a light sensor 222 is situated inside the light-source tube 212. The light sensor 222 reacts mainly to spectral reflected light and discriminates low-gloss paper and high-gloss paper.

Further, a technique for determining the coarseness of paper by capturing the surface image of the paper by a CCD area sensor and finding the fractal dimension has been proposed (e.g., see Patent Reference 2: Japanese Patent Application Laid-Open No. 11-271037).

FIG. 10 is a flowchart illustrating the basic operation of a smoothness detector described in Patent Reference 2. The surface of a printing medium is illuminated with light by area illumination (step S2-1). Next, a shadow image formed by the reflected light of area illumination is read as a planar image by image detecting means inclusive of image reading means, and grayscale information is detected as multivalued image data (step S2-2). More specifically, the reflected light resulting from the illuminating light is shadowed owing to unevenness of the printing medium, depressions appear dark and protrusions appear bright. The shadow image is detected by the CCD of the image reading means. The detected grayscale information, which is the multivalued image data, is subjected to image processing by information processing means, whereby surface roughness of the printing medium is measured and calculated (step S2-3). An image-formation parameter value corresponding to the surface roughness measured and calculated is thenceforth decided and controlled by image formation control means (step S2-4). That is, in this example of the prior art, the surface roughness of the printing medium can be inferred by reading the grayscale information from the CCD.

Furthermore, video of a paper surface is shot, information concerning the paper is acquired and image forming conditions are changed over (e.g., see Patent Reference 3: Japanese Patent Application Laid-Open No. 2002-182518).

By using the results obtained by discriminating types of printing media by these discrimination methods, an image forming apparatus performs printing upon selecting the printing modes that conform to the printing media of each type.

However, the surface conditions of a paper type differ depending upon the manufacturing lot and environment, and therefore the results of discrimination tend to vary. Further, even if many printing modes are provided in order to perform ideal image formation control in dependence upon various paper types, many types of printing paper are available on the market and therefore it is very difficult to set the correct paper-type mode without mistaking the paper type.

Accordingly, with a paper type in the vicinity of a threshold value, printing may be performed in the wrong mode if discrimination performed automatically is erroneous. If discrimination performed manually is erroneous, a case may arise in which printing cannot be performed.

Further, in a case where paper type has been discriminated using an image sensor such as an area sensor or line sensor, the amount of image data becomes very large and communication error becomes a possibility. If printing is halted whenever such anomalies occur, there is a possibility that the user will be subjected to stress.

Furthermore, with regard to printing on translucent media, there are cases where printing is performed without adding on a counterfeit preventing signal. Consequently, if plain paper is erroneously discriminated as translucent media, there is the danger that printing will be performed without printing the counterfeit preventing signal.

SUMMARY OF THE INVENTION

Accordingly, an object of the present invention is to form an image in the most stable image forming mode in a case where an abnormality has occurred when the type of printing medium or surface condition is discriminated.

Another object of the present invention is to add on a counterfeit preventing signal without changing mode in a case where a determination as to whether a printing medium is a translucent medium or not is ambiguous or in a case where a communication malfunction or sensor abnormality occurs during a continuous printing mode for continuous printing on a translucent medium, thereby enabling stable operation and, at the same time, preventing counterfeiting in reliable fashion.

According to the present invention, the foregoing objects are attained by providing an image forming method, which has image reading means for reading the surface of a printing medium on which an image will be formed, for setting an image forming parameter based upon the surface image that has been read by the image reading means, and forming an image, the method comprising the steps of: discriminating the type of printing medium based upon the surface image of the printing medium that has been read by the image reading means; and forming an image, without changing the image forming parameter, if it has been discriminated at the discriminating step that the printing medium is of a type other than a prescribed printing medium.

In accordance with an embodiment of the present invention, there is provided an image forming apparatus, which has image reading means for reading the surface of a printing medium on which an image will be formed, for setting an image forming parameter based upon the surface image that has been read by the image reading means, and forming an image, the apparatus comprising: discriminating means for discriminating the type of printing medium based upon the surface image of the printing medium that has been read by the image reading means; and image forming means for forming an image, without changing the image forming parameter, if it has been discriminated by the discriminating means that the printing medium is of a type other than a prescribed printing medium.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENT

A preferred embodiment of the present invention will now be described in detail with reference to the drawings.

Figure 1:
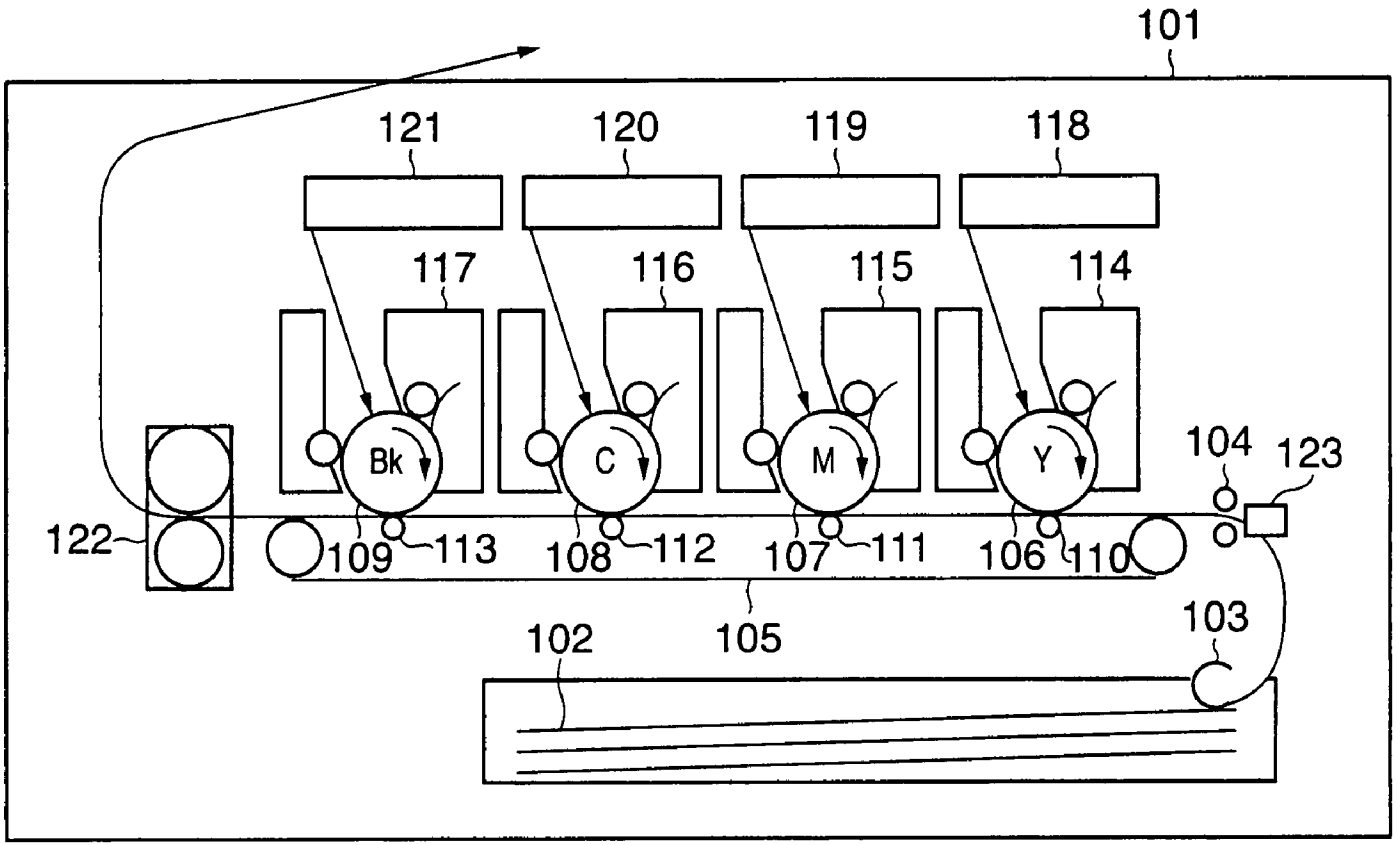
FIG. 1 is a sectional view illustrating the structure of an image forming apparatus according to an embodiment of the present invention.

FIG. 1 is a sectional view illustrating the structure of an image forming apparatus 101 according to an embodiment of the present invention. As shown in FIG. 1, the image forming apparatus 101 includes a paper cassette 102, a paper feeding roller 103, transfer-belt driving rollers 104, a transfer belt 105, photosensitive drums 106 to 109 for the colors yellow, magenta, cyan and black, respectively, transfer rollers 110 to 113, cartridges 114 to 117 for the colors yellow, magenta, cyan and black, respectively, optical units 118 to 121 for the colors yellow, magenta, cyan and black, respectively, and a fixing unit 122.

The image forming apparatus 101 uses an electrophotographic process to transfer toner images of the colors yellow, magenta, cyan and black to printing paper, thereby superimposing the images, and thermally fixes the toner images by the fixing unit 122 based upon temperature control.

The optical units 118 to 121 of the respective colors are arranged so as to form latent images by scanning and exposing the surfaces of the photosensitive drums 106 to 109 by laser beams. This series of image forming operations is such that scanning control is implemented in synchronized fashion to transfer the image from a predetermined position on the printing paper, which is the printing medium transported.

The image forming apparatus 101 has a paper feeding motor for feeding and transporting the printing paper serving as the printing medium, a transfer-belt driving motor for driving the transfer-belt driving rollers 104, a photosensitive-drum driving motor for driving the photosensitive drums 106 to 109 and the transfer rollers 110 to 113, and a fixation driving motor for driving fixing rollers.

An image reader 123 (also referred to as an image reading sensor) illuminates the surface of the fed and conveyed printing paper, forms an image by condensing the reflected light and detects an image in a specific area of the printing paper.

Further, a CPU (not shown) with which the image forming apparatus 101 is equipped applies a desired amount of heat to the printing paper by the fixing unit 122, thereby fusing and fixing the toner image on the printing paper.

Processing executed by the control CPU for controlling the image forming process of the image forming apparatus 101 will be described next.

Figure 2:
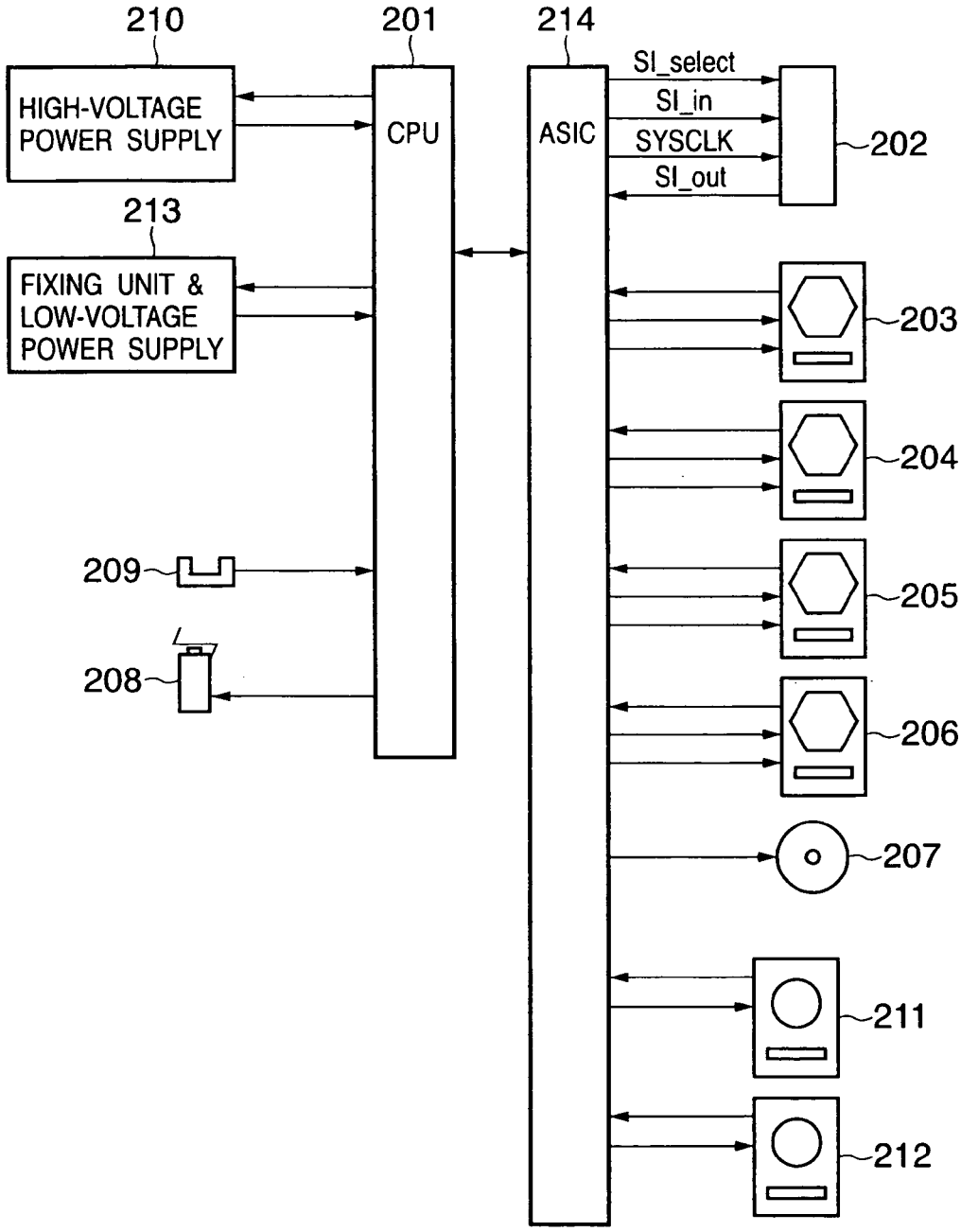
FIG. 2 is a diagram illustrating a plurality of units controlled by a CPU in this embodiment.

FIG. 2 is a diagram illustrating a plurality of units controlled by a control CPU 201 of this embodiment. The control CPU 201 (referred to below as a CPU) in FIG. 2 performs overall control of the image forming apparatus 101. A sensor 202 corresponds to the image reading sensor 123 shown in FIG. 1. The structure and operation of the sensor 202 will be described later. Optical units 203 to 206 correspond to the optical units 118 to 121. Each of these includes a polygon mirror, motor and laser, scans the surface of the photosensitive drum by the laser and forms the desired latent image.

A paper feeding motor 207 feeds and transports the printing paper serving as the printing medium, and a paper feeding solenoid 208 starts driving the paper feeding roller 103. A paper sensor 209 senses whether or not the printing medium has been placed at a predetermined position. A high-voltage power supply 210 controls primary charging, development, primary transfer and secondary transfer bias necessary for the electrophotographic process. A photosensitive-drum driving motor 211 drives the photosensitive drums and transfer rollers. A transfer-belt driving motor 212 drives the rollers of the transfer belt and fixing unit. The CPU 201 monitors temperature by a thermister (not shown) and exercises control to hold the fixing temperature constant.

Based upon commands from the CPU 201, an ASIC 214 controls the sensor 202, the speed of the motors in the optical units 203 to 206 and the speed of the paper feeding motor 207.

These motors are controlled by detecting a tachometer signal from the motor (not shown) and outputting an acceleration or deceleration signal to the motor in such a manner that the interval of the tachometer signal will become a prescribed length of time. This means that implementing the control circuit by the hardware of the ASIC 214 is advantageous in that the control load on the CPU 201 is alleviated.

Upon receiving a print command in response to an indication from a host computer (not shown), the CPU 201 determines whether the printing medium is present or not by the paper sensor 209. If the printing paper is present, the CPU 201 drives the paper feeding motor 207, photosensitive-drum driving motor 211 and transfer-belt driving motor 212 and drives the paper feeding solenoid 208 to transport the printing medium to a predetermined position. When the printing medium is transported to the position of the sensor 202, the CPU 201 instructs the ASIC 214 to start imaging by the sensor 202, whereby the sensor 202 senses the image on the surface of the printing medium.

At this time the ASIC 214 activates an SI_select signal, after which the ASIC 214 outputs a system clock (SYSCLK) of prescribed pulses at a predetermined timing and reads in imaging data that is output from the sensor 202 as an SI_out signal.

To set the gain of the sensor 202, the CPU 201 sets a predetermined value in a register within the ASIC 214, in response to which the ASIC 214 activates the SI_select signal. Then, at a predetermined timing, the ASIC 214 outputs the system clock of prescribed pulses and sets gain in the sensor 202 as an SI_in signal.

The ASIC 214 is equipped with a processing circuit for executing first and second operations, described later. The result of these operations is stored in a register within the ASIC 214. The CPU 201 reads in the content of the register within the ASIC 214, discriminates the type of printing medium transported and variably controls development bias conditions of the high-voltage power supply 210 in accordance with the result of discrimination so as obtain the optimum printing mode.

At this time the CPU 201 prepares a plurality of printing modes in advance and it is assumed that image formation parameters such as an optimum development bias, transfer bias, fixing temperature and transport speed have been set for each mode. For example, if the printing medium is rough paper whose surface fibers are coarse, the development bias is made less than that for plain paper and the amount of toner that is affixed to the surface of the printing medium is suppressed to prevent scattering of toner.

Further, the CPU 201 discriminates the type of printing medium fed and variably controls the temperature conditions of a fixing unit 213 in accordance with the result of discrimination. This is effective particularly in the case of an OHT (Overhead Transparency) film, namely in dealing with the problem of reduced transparency of an OHT film when the fixation of toner to the surface of the printing medium is poor.

Furthermore, the CPU 201 discriminates the type of printing medium fed and variably controls the transport speed of the printing medium in accordance with the result of discrimination. Variable control of transport speed is realized by having the CPU 201 set the value of the speed-control register in ASIC 214, which administers speed control. In particular, in the case of OHT or glossy paper, this improves the fixation of toner that attaches itself to the surface of the printing medium and raises gloss to improve image quality.

Figure 3:
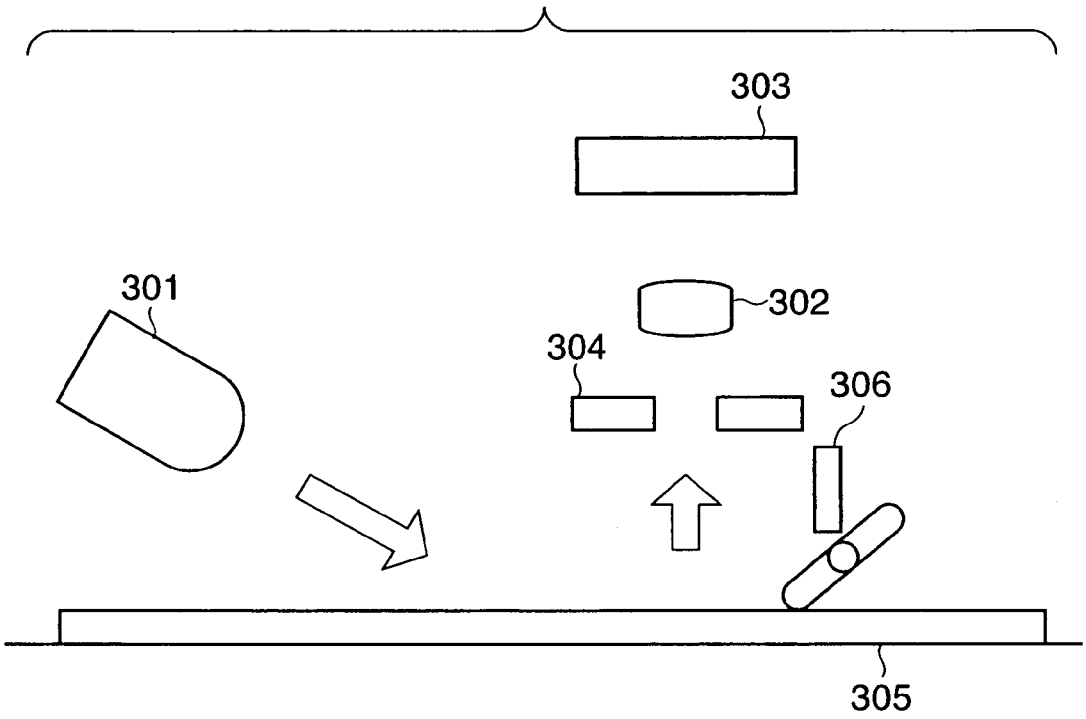
FIG. 3 is a diagram illustrating the general construction of a sensor shown in FIG. 2.

FIG. 3 is a diagram illustrating the general structure of the sensor 202 shown in FIG. 2. The sensor 202 includes a light source 301, a lens 302, a CMOS area sensor 303 and a diaphragm 304. The CMOS area sensor 303 may be a line sensor. Further, the diaphragm 304 need not be provided.

The CMOS area sensor 303 is situated at a position where it can detect the image of the surface of a printing medium 305 via the lens 302. The light source 301 is situated at a position where it can illuminate the surface of the printing medium 305 in an area detected by the sensor 303.

It should be noted that the printing medium 305 to undergo detection may be transported by transport rollers and that belt conveyance need not be used.

Next, when the transported printing medium 305 is sensed by a top sensor 306, the printing medium 305 is illuminated by the light source 301 and the surface image of the printing medium 305 is formed on the CMOS area sensor 303 via the diaphragm 304 and lens 302.

The hardware implementation and operation of the CMOS area sensor 303 shown in FIG. 3 will now be described.

Figure 4:
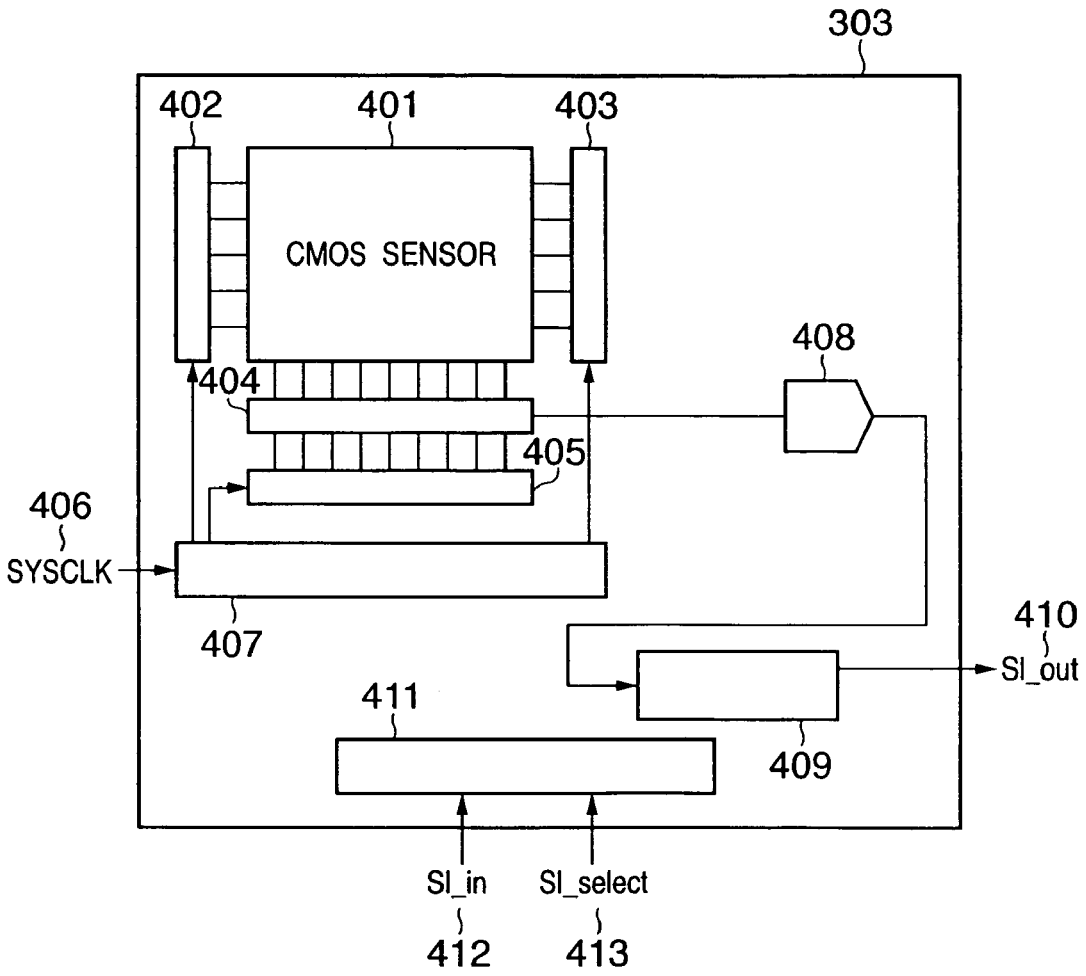
FIG. 4 is a block diagram illustrating the hardware implementation of a CMOS area sensor.

FIG. 4 is a block diagram illustrating the hardware implementation of the CMOS area sensor 303. As shown in FIG. 4, the CMOS area sensor 303 includes a CMOS sensor 401 comprising sensors made of, e.g., 64×64 pixels arrayed in an area configuration. Vertically directed shift registers 402, 403 select columns of pixels read out of the CMOS sensor 401. An output buffer 404 holds the electric charges of the pixel columns that have been read out of the CMOS sensor 401. A horizontally direction shift register 405 successively selects and outputs the charges held in the output buffer 404. A system clock (SYSCLK) 406 is applied to a timing generator 407. An A/D converter 408 converts the electric charge, which has been input thereto, to digital pixel data. An output interface circuit 409 outputs the pixel data as an SI_out signal 410. A control circuit 411 control the conversion gain of the A/D converter 408.

When an SI_select signal 413 is activated, the CMOS sensor 401 starts accumulating charge that is based upon the light received. Next, when the system clock 406 is applied, the vertical shift registers 402, 403 successively select the columns of pixels read out of the CMOS sensor 401 in accordance with the timing generator 407, and the charges of the selected pixel columns are held successively by the output buffer 404.

The electric charges held in the output buffer 404 are transferred to the A/D converter 408 by the horizontal shift register 405. Pixel data obtained by the digital conversion in the A/D converter 408 is controlled at a predetermined timing by the output interface circuit 409 and the data is output as the SI_out signal 410 during the period of time that the SI_select signal 413 is active.

Meanwhile, the control circuit 411 is capable of variably controlling the A/D conversion gain of the A/D converter 408 in response to an SI_in signal 412 specified externally. In a case where, e.g., contrast of the captured image is not obtained, the CPU of the control circuit 411 changes the gain so that imaging can be performed at the optimum contrast at all times.

It should be noted that the output of each light-receiving element is delivered at the negative-going timing of the system clock (SYSCLK) 406. Eight bits per pixel are transmitted serially with the falling edge of an SD_RD signal. The output method is not required to be serial and may just as well be parallel.

Figure 5:
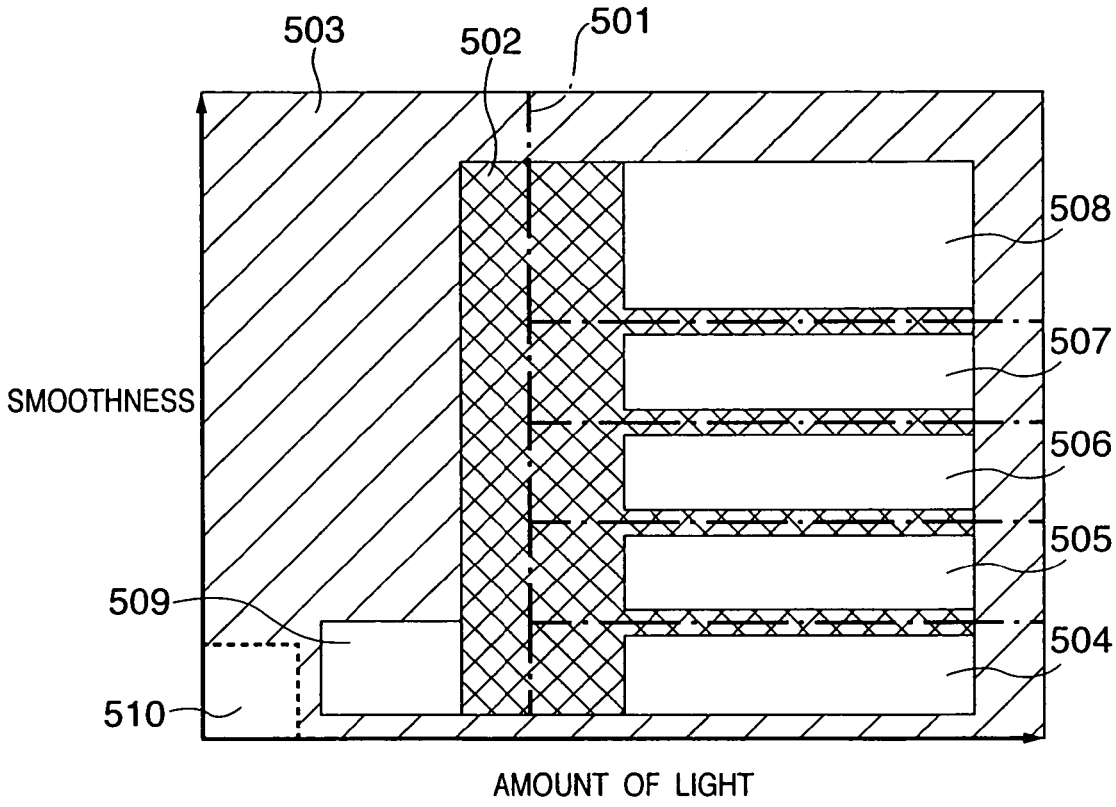
FIG. 5 is a diagram illustrating a distribution of results of detecting types of printing media by the CMOS area sensor.

FIG. 5 is a diagram illustrating a distribution of results obtained by detecting types of printing media by the CMOS area sensor. By an operation described later, the CMOS area sensor 303 outputs smoothness and an average value of amount of light of all pixels.

In FIG. 5, the dashed line indicated at 501 is a threshold value of amount of light. The white portions indicate results in a case where measurement could be performed correctly. The distribution has a glossy film area 504, a glossy paper area 505, a color-LBP special-purpose paper area 506, a plain paper area 507 and a rough paper area 508.

The lattice portion indicated at 502 is an area in the vicinity of the threshold value 501. Results of detection cannot be specified in this area. In this case, therefore, image formation is performed upon deciding on a more stable paper type (of the two neighboring paper types, the paper type decided on is the one nearer to plain paper). For example, in a case where the location is between the glossy paper area 505 and color-LBP special-purpose paper area 506, the color-LBP special-purpose paper, which is near plain paper, is decided upon and the image is formed in the plain paper mode.

In another example of implementation, if continuous printing is in progress, then printing is performed upon selecting the paper type for which there are many past results of detection.

Further, in another example of implementation, modes of the two types "IMAGE PRIORITY" and "NORMAL" are provided in advance and printing is performed in the high-stability mode if "NORMAL" has been set. If "IMAGE PRIORITY" has been set, re-measurement or manual setting is performed if there is any ambiguity.

Further, the shaded portion indicated at 503 is an abnormal-result area in a case where an obviously abnormal value is indicated. In this case, there is the possibility that results have been affected by contaminants adhering to the lens or contaminants on the paper itself. In such cases, therefore, the normal mode is used.

By exercising such control for avoiding a printing-stop mode in a case where there is the possibility of mistaken detection or a case where it seems that an abnormality has occurred, there is a reduction in the number of times a user is dissatisfied and stress upon the user can be mitigated.

Described next will be a method in which the ASIC 214 discriminates the type of printing medium and the surface state thereof based upon the surface image of the printing medium imaged by the sensor 202 (the CMOS area sensor 303 illustrated in FIG. 3).

Figure 6:
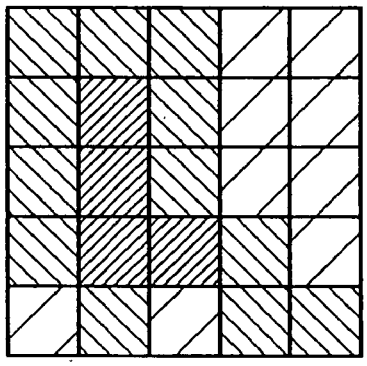
FIG. 6 is a diagram illustrating a surface image in a case where the surface of a printing medium has little unevenness.
Figure 7:
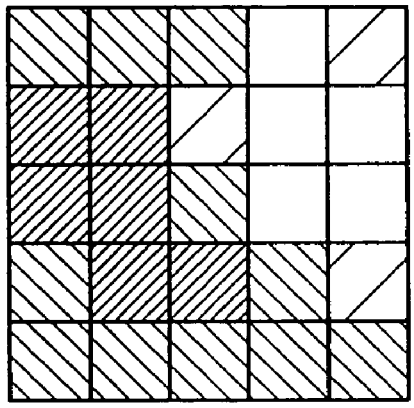
FIG. 7 is a diagram illustrating a surface image in a case where the surface of a printing medium has great unevenness.

FIG. 6 is a diagram illustrating a surface image in a case where the surface of the printing medium 305 has little unevenness. Further, FIG. 7 is a diagram illustrating a surface image in a case where the surface of the printing medium has great unevenness. As shown in FIGS. 6 and 7, the surface image (FIG. 7) in case of a highly uneven surface has a higher contrast in comparison with a surface image (FIG. 6) having little unevenness. It should be noted that contrast can be calculated by calculating the difference between maximum and minimum values of results of detection.

Figure 8:
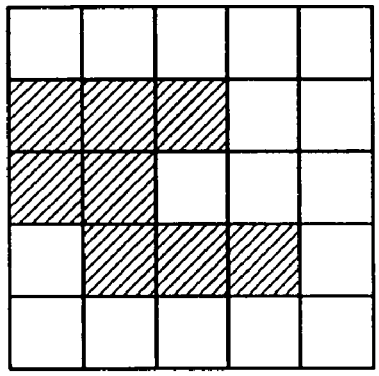
FIG. 8 is a diagram illustrating an image obtained by binarizing a surface image of the kind shown in FIG. 6.

Accordingly, the ASIC 214 is capable of detecting the magnitude of surface unevenness by calculating the difference between maximum and minimum values (this shall be referred to as a "first operation") based upon the surface image captured by the sensor 202. Further, the width of unevenness can be calculated by binarizing the surface image of FIG. 6 in the manner shown in FIG. 8 and counting the number of edges (this shall be referred to as a "second operation").

Accordingly, in a case where a binarization threshold value is made the average value of the immediately preceding line or an average value of the overall image captured one image earlier, the sensor itself is provided with a mechanism for obtaining the average value and the average value is output to the ASIC 214, whereby the amount of calculation performed by the ASIC 214 can be reduced. As a result, it becomes possible to achieve higher speed, smaller size and lower cost.

Thus, based upon the magnitude and width of surface unevenness of the printing medium, the control CPU of the image forming apparatus discriminates the type of printing medium and its surface state and controls the image forming conditions accordingly, thereby making it possible to form an excellent image irrespective of the type of printing medium and surface state thereof.

It should be noted that the magnitude of unevenness or the width of unevenness may be used as "SMOOTHNESS" in FIG. 5.

Thus, in accordance with this embodiment as described above, an image forming apparatus can be used in a more stable state.

[First Modification]

A first modification of this embodiment will be described in detail. The structure of the first modification basically is similar to that described in the above embodiment and therefore only the portions that differ from the embodiment will be described.

As the first modification, there will be described a control method for a case where a communication error occurs when the sensor 202 (the CMOS area sensor 303 shown in FIG. 3) captures the surface image of the printing medium 305 and outputs this result to the ASIC 214.

First, when the printing medium 305 is transported to the position of the CMOS area sensor 303, the CPU 201 instructs the ASIC 214 to perform imaging with the CMOS area sensor 303, in response to which the CMOS area sensor 303 senses the surface image of the printing medium.

At this time, the ASIC 214 activates the SI_select signal, after which the ASIC 214 outputs the system clock (SYSCLK) of prescribed pulses at a predetermined timing and reads in imaging data that is output from the sensor 202 as the SI_out signal. An instance where the number of pulses of the system clock and the SI_out signal are not at the prescribed values when the imaging data is read in is assumed to be a communication error.

If a communication error has occurred, the sensed image is invalid. As a consequence, the surface smoothness of the printing medium cannot be measured. In this case also printing is not halted and printing is performed in the normal mode. Alternatively, printing is performed in the mode used for the immediately preceding paper.

Further, in a case where result of detection of an LED OFF or LED malfunction area 510 shown in FIG. 5 is indicated despite the fact that the LED has been positively turned on at the time of detection during printing, it is decided that there is good possibility that the LED is malfunctioning. In this case also printing is not halted and is performed in the normal mode.

In accordance with the first modification, as described above, the image forming apparatus can be used more stably in a case where a communication error has occurred or in a case where an LED has malfunctioned.

[Second Modification]

A second modification of this embodiment will be described in detail. The structure of the second modification basically is similar to that described in the above embodiment and therefore only the portions that differ from the embodiment will be described.

As the second modification, there will be described a control method for a case where the sensor 202 (the CMOS area sensor 303 shown in FIG. 3) captures the surface image of the printing medium 305 and cannot judge reliably whether the printing medium is an OHT film or reflective medium.

If the printing medium 305 is transported to the position of the CMOS area sensor 303 in a case where the setting made by the user is OHT or in a case where the initial printing medium used in continuous printing is OHT film, the CPU 201 instructs the ASIC 214 to perform imaging with the CMOS area sensor 303, in response to which the CMOS area sensor 303 senses the surface image of the printing medium.

If at this time the overall amount of light of the captured image is lower than the threshold value 501 shown in FIG. 5, i.e., in case of an OHT area 509, it is conceivable that the printing medium is OHT film. However, if the result is in the area 502 in the proximity of the threshold value, then a decision is rendered to the effect that whether the printing medium is OHT film or a reflective medium could not be positively determined, printing is not halted and image formation is performed with the same parameters without changing the printing mode, i.e., in the printing mode that was used for the immediately preceding page. If the result of detection is in the area in the proximity of the threshold value in a case where there is no immediately preceding page, i.e., in a case where this is the first page of the job of image formation extending over a plurality of pages, then the image formation parameters are set upon deciding on the type of printing medium having the higher stability, just as in the above-described embodiment.

At the same time, in a case where a color image is printed out by the image forming apparatus, a dot pattern indicative of information relating to the image forming apparatus is added to the color image in a state in which the pattern is not readily recognizable by the human eye. This is a measure for avoiding problems related to counterfeiting of currency and securities and infringement of copyrights.

In accordance with the second modification, as described above, the image forming apparatus can be used more stably in a case where it cannot be reliably determined whether a printing medium is an OHT film or reflective medium.

The present invention can be applied to a system constituted by a plurality of devices (e.g., a host computer, interface, reader, printer, etc.) or to an apparatus comprising a single device (e.g., a copier or facsimile machine, etc.).

Furthermore, it goes without saying that the object of the invention is attained also by supplying a recording medium storing the program codes of the software for performing the functions of the foregoing embodiment to a system or an apparatus, reading the program codes with a computer (e.g., a CPU or MPU) of the system or apparatus from the recording medium, and then executing the program codes.

In this case, the program codes per se read from the recording medium implement the novel functions of the embodiment and the recording medium storing the program codes constitutes the invention.

Examples of recording media that can be used for supplying the program code are a floppy disk, hard disk, optical disk, magneto-optical disk, CD-ROM, CD-R, magnetic tape, non-volatile type memory card or ROM, etc.

Furthermore, besides the case where the aforesaid functions according to the embodiment are implemented by executing the program codes read by a computer, it goes without saying that the present invention covers a case where an operating system or the like running on the computer performs a part of or the entire process in accordance with the designation of program codes and implements the functions according to the embodiment.

It goes without saying that the present invention further covers a case where, after the program codes read from the storage medium are written in a function expansion board inserted into the computer or in a memory provided in a function expansion unit connected to the computer, a CPU or the like contained in the function expansion board or function expansion unit performs a part of or the entire process in accordance with the designation of program codes and implements the function of the above embodiment.

In accordance with the embodiment, as described above, an image can be formed in the most stable image forming mode in a case where an abnormality has occurred when the type of printing medium or surface condition is discriminated.

Furthermore, a counterfeit preventing signal is added on without changing mode in a case where a determination as to whether a printing medium is a translucent medium or not is ambiguous or in a case where a communication malfunction or sensor abnormality occurs during a continuous printing mode for continuous printing on a translucent medium, thereby enabling stable operation and, at the same time, preventing counterfeiting in reliable fashion.

As many apparently widely different embodiments of the present invention can be made without departing from the spirit and scope thereof, it is to be understood that the invention is not limited to the specific embodiments thereof except as defined in the appended claims.

What is claimed is:

1. An image forming method, for an apparatus which has image reading means for reading the surface of a printing medium on which an image will be formed, for setting an image forming parameter based upon the surface image that has been read by the image reading means, and forming an image, the method comprising:

a discriminating step of discriminating the type of printing medium based upon the surface image of the printing medium that has been read by the image reading means; and an image forming step of forming an image, without changing the image forming parameter, if it has been discriminated at said discriminating step that the printing medium is of a type other than a prescribed printing medium, wherein said image forming step forms an image upon setting a default for the image forming parameter in a case where communication with the image reading means is impossible.

2. A program embodied in a computer-readable medium for causing a computer to execute the steps of the image forming method set forth in claim 1.

3. A computer-readable recording medium on which the program set forth in claim 2 has been recorded.

4. The method according to claim 1, wherein said discrimination step discriminates the type of printing medium in accordance with smoothness of the surface image.

5. The method according to claim 4, wherein said discrimination step comprises a calculating step of calculating magnitude and width of surface unevenness of the printing medium.

6. An image forming method, for an apparatus which has image reading means for reading the surface of a printing medium on which an image will be formed, for setting an image forming parameter based upon the surface image that has been read by the image reading means, and forming an image, the method comprising:

a discriminating step of discriminating the type of printing medium based upon the surface image of the printing medium that has been read by the image reading means; and an image forming step of forming an image, without changing the image forming parameter, if it has been discriminated at said discriminating step that the printing medium is of a type other than a prescribed printing medium, wherein said image forming step forms an image upon setting a default for the image forming parameter in a case where a reading sensor in the image reading means has malfunctioned.

7. The method according to claim 6, wherein said discrimination step discriminates the type of printing medium in accordance with smoothness of the surface image.

8. The method according to claim 7, wherein said discrimination step comprises a calculating step of calculating magnitude and width of surface unevenness of the printing medium.

9. An image forming method, for an apparatus which has image reading means for reading the surface of a printing medium on which an image will be formed, for setting an image forming parameter based upon the surface image that has been read by the image reading means, and forming an image, the method comprising:

a discriminating step of discriminating the type of printing medium based upon the surface image of the printing medium that has been read by the image reading means; and an image forming step of forming an image, without changing the image forming parameter, if it has been discriminated at said discriminating step that the printing medium is of a type other than a prescribed printing medium, wherein said image forming step forms an image upon adding on a counterfeit preventing signal without changing the image forming parameter in a case where it cannot be determined whether the type of printing medium is a translucent medium or a reflective medium.

10. The method according to claim 9, wherein said discrimination step discriminates the type of printing medium in accordance with smoothness of the surface image.

11. The method according to claim 10, wherein said discrimination step comprises a calculating step of calculating magnitude and width of surface unevenness of the printing medium.

12. An image forming apparatus, which has image reading means for reading the surface of a printing medium on which an image will be formed, for setting an image forming parameter based upon the surface image that has been read by the image reading means, and forming an image, the apparatus comprising:

discriminating means for discriminating the type of printing medium based upon the surface image of the printing medium that has been read by said image reading means; and image forming means for forming an image, without changing the image forming parameter, if it has been discriminated by said discriminating means that the printing medium is of a type other than a prescribed printing medium, wherein said image forming means forms an image upon setting a default for the image forming parameter in a case where communication with said image reading means is impossible.

13. The method according to claim 12, wherein said discrimination means discriminates the type of printing medium in accordance with smoothness of the surface image.

14. The method according to claim 13, wherein said discrimination means comprises calculating means for calculating magnitude and width of surface unevenness of the printing medium.

15. An image forming apparatus, which has image reading means for reading the surface of a printing medium on which an image will be formed, for setting an image forming parameter based upon the surface image that has been read by the image reading means, and forming an image, the apparatus comprising:

discriminating means for discriminating the type of printing medium based upon the surface image of the printing medium that has been read by said image reading means; and image forming means for forming an image, without changing the image forming parameter, if it has been discriminated by said discriminating means that the printing medium is of a type other than a prescribed printing medium, wherein said image forming means forms an image upon setting a default for the image forming parameter in a case where a reading sensor in said image reading means has malfunctioned.

16. The apparatus according to claim 15, wherein said discrimination means discriminates the type of printing medium in accordance with smoothness of the surface image.

17. The apparatus according to claim 16, wherein said discrimination means comprises calculating means for calculating magnitude and width of surface unevenness of the printing medium.

18. An image forming apparatus, which has image reading means for reading the surface of a printing medium on which an image will be formed, for setting an image forming parameter based upon the surface image that has been read by the image reading means, and forming an image, the apparatus comprising:

discriminating means for discriminating the type of printing medium based upon the surface image of the printing medium that has been read by said image reading means; and image forming means for forming an image, without changing the image forming parameter, if it has been discriminated by said discriminating means that the printing medium is of a type other than a prescribed printing medium, wherein said image forming means forms an image upon adding on a counterfeit preventing signal without changing the image forming parameter in a case where it cannot be determined whether the type of printing medium is a translucent medium or a reflective medium.

19. The apparatus according to claim 18, wherein said discrimination means discriminates the type of printing medium in accordance with smoothness of the surface image.

20. The apparatus according to claim 19, wherein said discrimination means comprises calculating means for calculating magnitude and width of surface unevenness of the printing medium.

* * * * *

UNITED STATES PATENT AND TRADEMARK OFFICE

CERTIFICATE OF CORRECTION

PATENT NO. : 7,095,968 B2
APPLICATION NO. : 10/862384
DATED : August 22, 2006
INVENTOR(S) : Masanori Akita et al.

Figure 9:
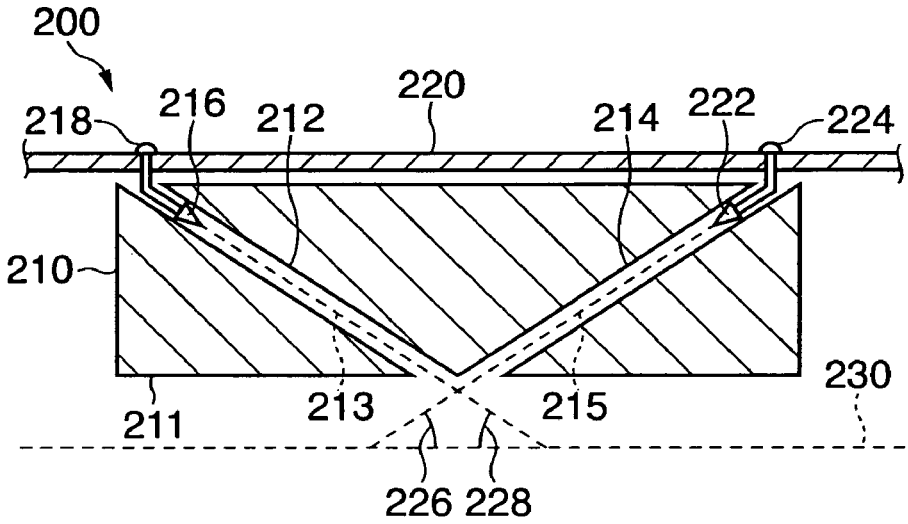
FIG. 9 is a sectional view of a printer glossmeter described in Patent Reference 1.

It is certified that error appears in the above-identified patent and that said Letters Patent is hereby corrected as shown below:

SHEET NO. 9 of 10:
Figure 9: Should be labeled --PRIOR ART--.

Figure 10:
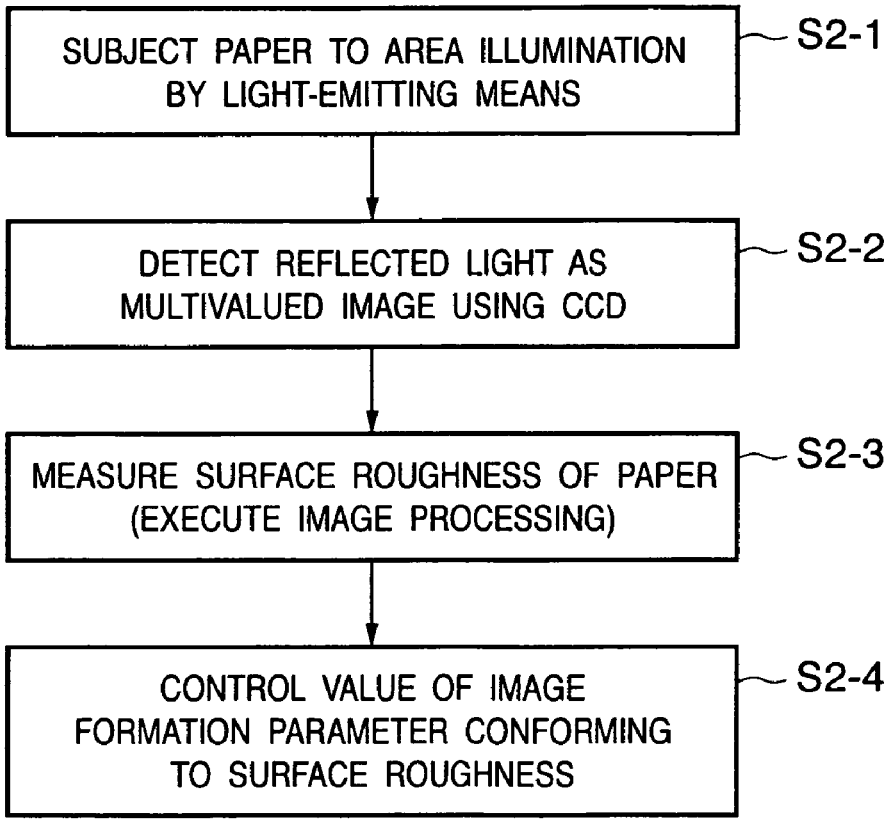
FIG. 10 is a flowchart illustrating the basic operation of a smoothness detector described in Patent Reference 2.

SHEET NO. 10 of 10:
Figure 10: Should be labeled --PRIOR ART--.

COLUMN 2:
Line 818, "in dependence" should read --depending--.

COLUMN 6:
Line 22, "horizontally" should read --horizontal--.
Line 28, "control" (second occurrence) should read --controls--.

Signed and Sealed this

First Day of May, 2007

JON W. DUDAS
*Director of the United States Patent and Trademark Office*